United States Patent [19]

Eshraghian et al.

[11] 4,276,539

[45] Jun. 30, 1981

[54] VEHICLE DETECTION SYSTEMS

[75] Inventors: Kamran Eshraghian, Hectorville; Robert E. Bogner, College Park, both of Australia

[73] Assignee: U.S. Philips Corporation, New York, N.Y.

[21] Appl. No.: 903,185

[22] Filed: Jun. 22, 1978

[51] Int. Cl.[3] ..... G08G 1/01

[52] U.S. Cl. ..... 340/38 L; 307/352; 324/234; 328/151

[58] Field of Search ..... 340/38 L, 38 R, 551, 340/552, 557; 324/233, 234, 236; 235/92 TC; 328/150, 151; 364/424, 551, 436–438; 307/352, 353

[56] References Cited

U.S. PATENT DOCUMENTS

| | | | |
|---|---|---|---|
| 3,115,622 | 12/1963 | Jaffe | 340/38 L |
| 3,801,976 | 4/1974 | Ross et al. | 340/38 L |
| 3,911,389 | 10/1975 | Mills | 340/38 L |
| 3,943,339 | 3/1976 | Koerner et al. | 340/38 L |
| 3,944,912 | 3/1976 | Angel et al. | 340/38 L |

FOREIGN PATENT DOCUMENTS

| | | | |
|---|---|---|---|
| 1245360 | 9/1971 | United Kingdom | 340/38 L |
| 1272224 | 4/1972 | United Kingdom | 340/38 R |

*Primary Examiner*—James J. Groody

[57] ABSTRACT

Disclosed is a vehicle detection system comprising a transmitter coupled to a receiver via a sensor arranged to produce a change in the envelope of the received signal upon passage of a vehicle. In order to distinguish between changes in the received signal caused by variations in the environmental conditions and the approach of a vehicle, the system is provided with an identification circuit which periodically samples the received signal. The sampled voltages, which are representative of the envelope of the received signal, are then stored and supplied to a comparator which compares the envelope with the sampled voltage and provides an output signal indicating approach of a vehicle when the difference between the envelope level and the sampled voltage exceeds a predetermined value.

4 Claims, 7 Drawing Figures

VEHICLE DETECTION SYSTEMS

Figure 1:
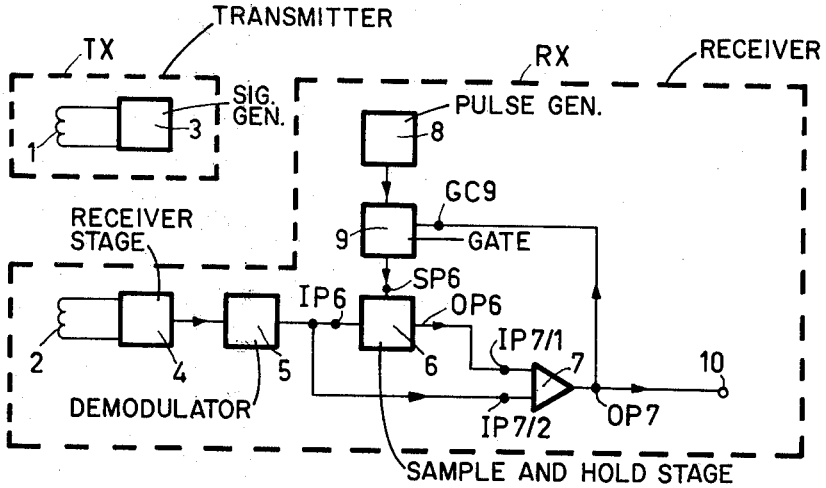

This invention relates to vehicle detection systems wherein a transmitter supplying a continuous wave signal is coupled to a receiver via sensing means so that the passage of each sensed vehicle produces a positive-going disturbance of the envelope of the received signal.

Vehicle detection systems of the kind to which the invention relates are known.

In one known system, the sensing means comprise a transmitting coil forming part of the transmitting means and inductively coupled to a receiving coil forming part of the receiving means, the sensing means being located beneath the road surface. As a vehicle enters the zone of influence, the inductive coupling between the transmitting coil and the receiving coil is influenced and causes a corresponding change in the level of the received signal.

Another known system of the kind to which the invention relates is that described in U.S. Pat. No. 3,493,954 in which a high frequency reference signal is applied to sensing means in the form of an inductive wire loop embedded in a roadway, the inductive wire loop being coupled to a detector circuit for detecting impedance changes resulting from the presence of a vehicle.

In systems of the kind to which the invention relates an amplitude selection process is sometimes employed to detect changes in the envelope level of the received signal. However, the coupling between the transmitting means and the receiving means is influenced also by environmental conditions and it is desirable to reliably distinguish between changes in the envelope level of the received signal due to a vehicle and changes due to environmental conditions such as weather or road surface changes. With amplitude selection processes, selection is related to a threshold level and, since an environmental change usually takes place over a longer period of time than that taken for passage of a vehicle, compensation for environmental changes may be achieved by control of the threshold level in accordance with the characteristics of a time constant. However, the choice of a relatively long time constant may render the system insensitive to the presence of vehicles in the event of a sudden environmental change whereas the choice of a relatively short time constant may render the system insensitive to the presence of a stationary or slow moving vehicle.

Moreover, where a plurality of similar systems of the kind to which the invention relates are employed in combination, the levels of the respective received signals may vary markedly from system to system owing to the differences of physical layout and local conditions associated with the respective sensing means. Such variations may necessitate adjustment of each system to a common level at the time of installation and from time to time thereafter.

The system according to the present invention requires no adjustment to a common level when used in association with other similar systems and is also capable of distinguishing between changes in the envelope level of the received signal due to a vehicle and changes due to environmental conditions. The system according to the present invention is also capable of detecting the presence of a stationary vehicle and facilitates distinguishing a moving vehicle from a stationary vehicle.

In accordance with the present invention the receiver of the system includes identification means comprising:

A sampler for deriving sample voltages corresponding with the envelope level of the received signal at periodically recurring sampling instants, storage means for storing each derived sample voltage until the next succeeding sampling instant, a comparator for comparing each stored sample voltage with the envelope level of the received signal and activating an information output when the envelope level exceeds the stored sample voltage by a fixed quantity thereby identifying positive-going disturbances of the envelope of the received signal having a sharply rising leading edge produced by the approach of a vehicle.

Preferably, but not necessarily, the sampler, storage means and comparator are combined with or form a pulse formation means responsive to the envelope level of the received signal upon activation of the information output for forming a vehicle indication pulse of duration related to that of the positive-going disturbance of the envelope producing such activation.

The repetition rate of the periodically recurring sampling instants and the fixed limit should be selected in relation to each other so that the information output is activated in response to positive-going disturbances of the envelope having a sharply rising leading edge produced by approach of a sensed vehicle but is not activated in response to positive-going disturbances having a relatively slowly rising leading edge produced by sensed environmental changes.

Various forms of the invention are possible.

In one form of the invention, the sampler is connected to be suppressed by activation of the information output so that the sampler, comparator and the storage means function in combination as the pulse formation means with the vehicle indicating pulses being produced at the information output.

in another embodiment of the invention, the sampler is continuously running in operation and the pulse formation means comprises a second storage means having reset means and data input, data output and storage command terminals wherein, following reset data present at the data input terminal is transferred to the data output terminal and, following activation of the storage command terminal, data present at the data input terminal at activation are transferred to and stored at the data output terminal until further reset and a second comparator for comparing data present at the data output terminal of the second storage means with the envelope level of the received signal so that the second comparator output is activated when the envelope level is greater than the level of the data output terminal, a signal representing the envelope level of the received signal being applied to the data input terminal, the storage command input terminal being activated by activation of the information output and the second storage means being reset by de-activation of the second comparator output.

Figure 2:
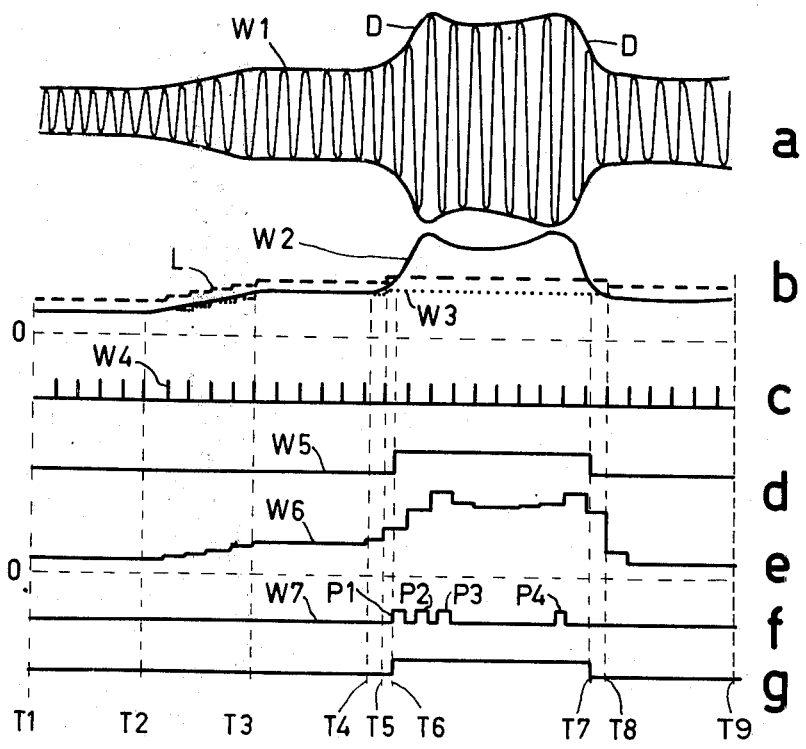
Figure 3:
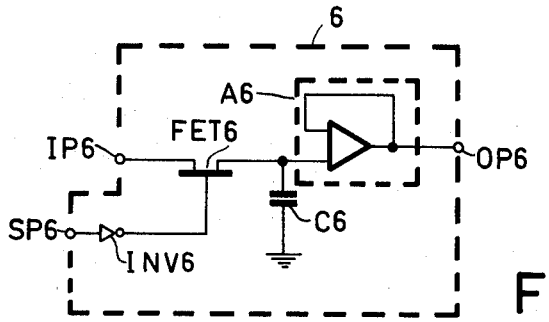
Figure 4:
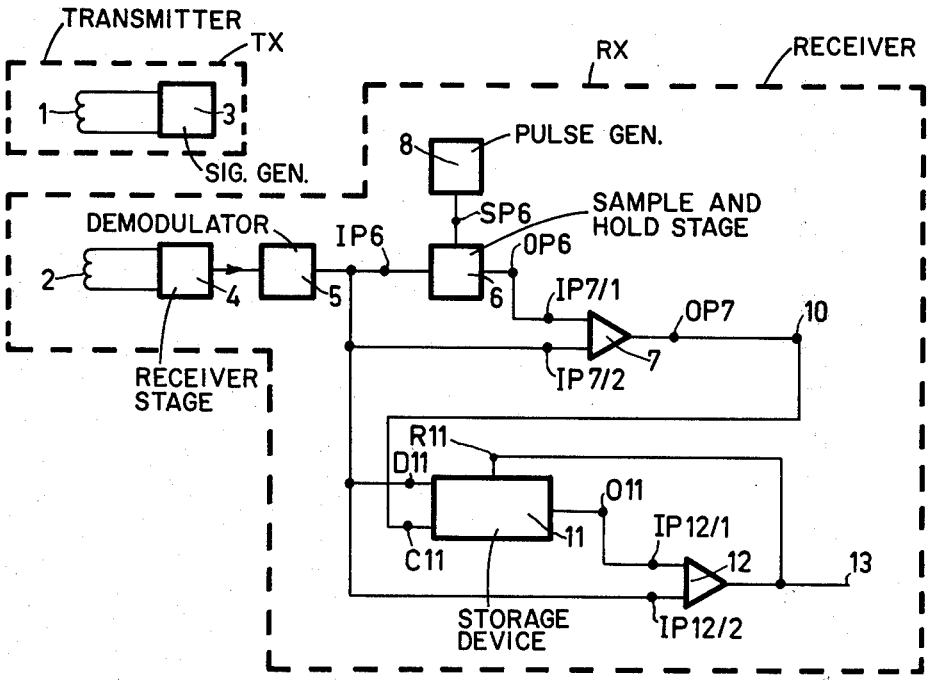
Figure 5:
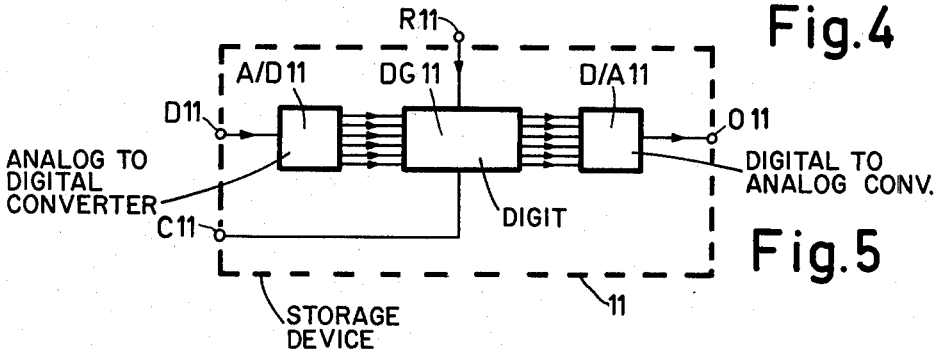

The invention is described more fully with reference to the accompanying drawings in which:

FIG. 1 is a block schematic diagram of a system embodying the present invention, FIGS. 2*a* to 2*g* depict a series of waveforms to assist in explaining the operation of the system of FIG. 1 and the system of FIG. 4, FIG. 3 is a diagram illustrating, in greater detail, a portion of the diagram of FIG. 1, FIG. 4 is a block schematic diagram of another system embodying the present invention, FIG. 5 is a schematic diagram illustrating, in greater detail, a portion of the diagram of FIG. 4.

Figure 6:
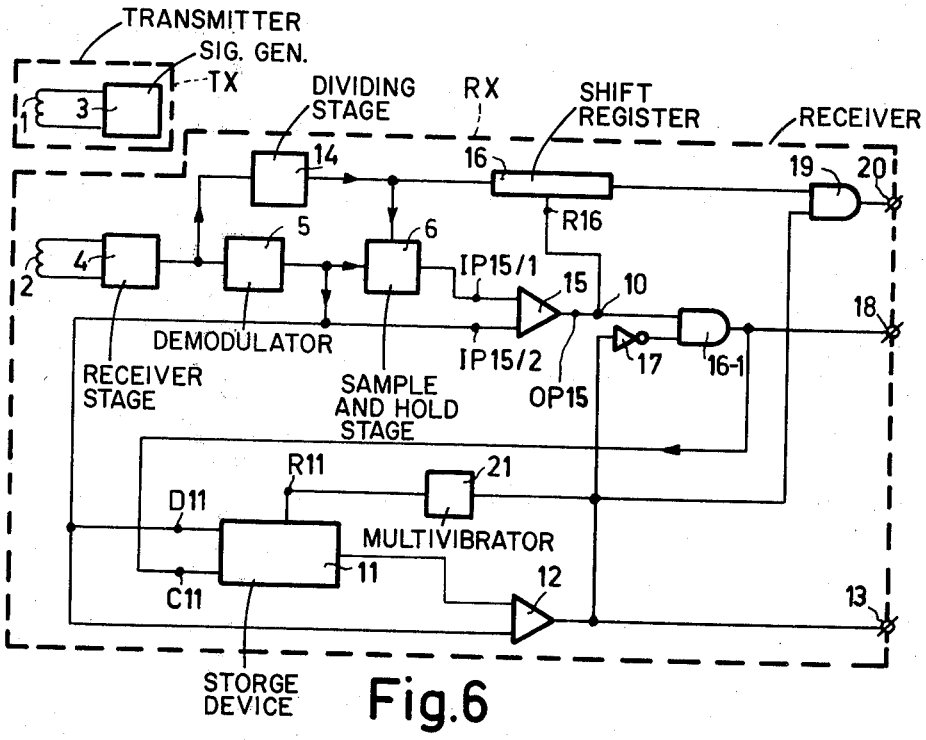

FIG. 6 is a block schematic of a further system embodying the present invention, FIGS. 7*a* to 7*j* depict a series of waveforms to assist in understanding the operation of the system of FIG. 6.

The system of FIG. 1 comprises a transmitter denoted by the letters TX and a receiver denoted by the letters RX. The transmitter coil 1 of the transmitter TX and the receiving coil 2 of the receiver RX are each located just beneath the surface of a roadway or traffic lane and spaced apart from each other with the respective coil axes substantially in alignment and orthogonal to the roadway or traffic lane so that the inductive coupling between the coil 1 and the coil 2 is influenced by the presence of a vehicle in the roadway or lane.

The generator 3 of the transmitter TX produces, in a known manner, a continuous wave signal of constant frequency (E.G. 100 KHz) which is fed to the transmitting coil 1 and radiated thereby.

Signals received by the receiving coil 2 are fed to the input of the receiving stage 4 which selects and amplifies, in a known manner, incoming signals within a predetermined bandwidth including the frequency of the signal radiated by the transmitting coil. Thus, the output signal of the receiving stage 4 is a continuous wave signal which is amplitude modulated whenever a vehicle passes over the sensing means formed by the coils 1 and 2.

The RF output signal of the receiving stage 4 is fed to a demodulation stage 5 wich may be any one of several known kinds of demodulator so that a signal corresponding to the envelope of the received signal is produced at its output.

The output signal produced by the demodulator 5 is simultaneously fed to one input IP7/2 of a comparator 7 and to the input IP6 of a sample and hold stage 6, the output of which is fed to the other input IP7/1 of the comparator 7. The output OP7 of the comparator 7 is connected to the output terminal 10 and also to the control terminal OC9 of the gate 9.

A free-running sampling pulse source 8 of a known kind produces sampling pulses at periodically recurring instants. For example, the sampling pulses may have a duration of 5 microseconds and recur at a pulse repetition frequency of 1 kilohertz. The sampling pulses produced by the source 8 are fed via the gate 9 to the sample and hold stage 6.

The waveform W1 of FIG. 2(*a*) depicts, by way of example, a waveform of a signal at the output of the receiving stage 4. The waveform W2 (represented by a solid line) and the waveform W3 (represented by a dotted line parts of which coincide with the solid line of waveform W2) in FIG. 2(*b*), respectively, depict the resultant signal produced at the output of the demodulator stage 5 corresponding to the envelope of the waveform W1 and the resultant output waveform produced by the sample and hold stage 6.

Between the instants T1 and T2 there is no vehicle within the zone of influence and the envelope level of the output signal is constant. Between the instants T2 and T3 there is a steady rise in the level of the envelope owing to a change of environmental conditions. Between the instants T3 and T4 the envelope level is constant once more. Between the instants T4 and T8 a vehicle is approaching and passing over the sensing means formed by the coils 1 and 2 and accordingly produces a positive going disturbance D in the envelope level. The waveshape of the disturbance being is determined by the characteristics of the passing vehicle. Between the instants T8 and T9 again there is no vehicle within the zone of the influence and the envelope level is constant.

It will be appreciated that the shape of the disturbance D of the envelope of the RF output signal W1 and also to the wave W2 between the instants T4 and T8 is the shape produced by the passage of a particular vehicle and that a different shape would be produced by a different vehicle. The shape of the envelope so formed can be referred to as the "signature waveform" of a vehicle. The length of time between the instants T4 and T8 is, of course, related to the length of the vehicle and to the speed of the vehicle in question.

The waveform W4 of FIG. 2(*c*) depicts the sampling pulse waveform produced by the source 8 and applied to the sample pulse input SP6 of the sample and hold stage 6 when the gate 9 is open. The waveform W5 of FIG. 2(*d*) depicts the resultant waveform produced at the output terminal 10.

A more detailed schematic diagram of the sample and hold stage 6 is illustrated in FIG. 3. Positive going sampling pulses illustrated in FIG. 2(*c*), which are derived from the source 8 via gate 9 are applied to the sampling pulse input terminal SP6. Simultaneously, the output signal of the demodulation stage 5 corresponding to the envelope of the received signal and, by way of example, as illustrated by the waveform W2 in FIG. 2(*b*) is applied to the input terminal IP6. The positive going sampling pulses fed to the terminal SP6 are fed via the inverter INV6 to the gate electrode of the field effect transistor FET6. Transistor FET6 functions as a switch which is closed whenever a sampling pulse is present and is otherwise open so that each time transistor FET6 is "closed", the capacitance C6 charges to a voltage corresponding to that of the input voltage present at the input terminal IP6 and holds the charge at the same voltage until the occurrence of the next succeeding sampling pulse, whereupon the process is repeated. The unity gain voltage follower A6 provides a high impedance across the capacitance C6 so that the charge across the capacitance C6 remains substantially constant between sampling pulses with the voltage produced at the output terminal OP6 coinciding with that present across the capacitance C6. Thus, a stepwise voltage corresponding to that illustrated by waveform W3 of FIG. 2(*b*) is produced across the capacitance C6 and also at the output terminal OP6 in response to a received signal as depicted by the waveform W1 of FIG. 2(*a*) and it will be appreciated that while sample pulses are fed to the sample and hold stage 6 (for example between the instants T1 and T4) the waveform W3 is periodically brought to the same level as the waveform W2 and has a constant amplitude between consecutive sampling pulse instants. Should supply of sample pulses to the terminal SP6 of the sample and hold stage 6 cease, then the amplitude of the waveform W5 remains constant at the envelope level at the time of the last occurring sampling instant.

With a received signal as depicted by the waveform W1, the waveforms W3 and W2 are respectively supplied to the input IP7/1 and the input IP7/2 of the comparator 7. The comparator 7 is a unidirectional comparator of known kind producing a logic "1" at the output terminal OP7 when the voltage applied to the input IP7/1 exeeds the voltage applied to the input IP7/2 by a fixed quantity being a characteristic of the unit employed (which in most instances would be an integrated circuit component of which several known kinds are appropriate), a logic "0" otherwise being produced at the output terminal OP7. The fixed quantity relating to the wave W3 can be denoted by a changing level and is denoted by the dotted line L in FIG. 2(*b*).

The gate 9 is also of known kind and is such that with a logic "0" present at the control terminal GC9, the gate is open whereas a logic "1" present at the terminal GC9 closes the gate, terminating supply of sampling pulses from the source 8 to the sample and hold stage 6.

Consider now the effect of the waveform W1 being received and the waveforms W2 and W3 consequently being produced at the inputs IP7/2 and IP7/1 respectively. As the amplitude of the waveforms W2 and W3 are the same between the instants T1 and T2, a logic "0" is produced at the output OP7 and the gate 9 is open. During the period between the instants T2 and T3, the envelope level of the received signal rises slowly and prior to each sampling instant denoted by the respective sample pulses P of the waveforms W4, the voltage of the wave W2 exceeds that of the wave W3. However, between the instants T2 and T3 the voltage difference between the waveforms W2 and W3 does not exceed the fixed quantity denoted by the line L and a logic "0" continues to be produced at the output terminal OP7 and hence at the output terminal 10. Again, during the period between the instants T3 and T4 the amplitude of the waveforms W2 and W3 is the same and logic "0" continues to be produced at the output terminal OP7.

Between the instants T4 and T5 there is a significant increase in the level of the waveform W2 owing to the disturbance D produced by the passage of a sensed vehicle. However, between the instants T4 and T5 the increase of voltage of the wave W2 relative to that of the waveform W3 again does not exceed the fixed quantity denoted by the line L so that the gate 9 remains open and the sampling pulse P1 is fed to the sample and hold stage 6 sampling the envelope level at the instant T5 resulting in a corresponding increase of the level of the waveform W3.

Owing to the sharply rising leading edge of the disturbance D, at the instant T6, between the sampling instants of the sample pulses P1 and P2, the level of the waveform W2 exceeds that of the waveform W3 by the fixed quantity whereupon a logic "1" is produced at the output terminal OP7 simultaneously closing the gate 9 so that the supply of sampling pulses to the sample and hold stage 6 ceases. Thus, the level of the waveform W3 remains at the envelope level present at the instant T5 and, as the level of the waveform W2 continues to exceed that of the waveform W3 by the fixed quantity until the instant T7, a logic "1" also continues to be produced at the output terminal OP7 until the instant T7 after which a logic "0" is produced. As the gate 9 is opened by a logic "0" being present at the terminal OP7 then following the instant T7, the supply of sampling pulses to the sample and hold stage 6 recommences.

It will be appreciated that a logic "1" is produced at the output terminal O/P7 and hence at the output terminal 10 only when the envelope level increases at a rapid rate and the sensitivity of the receiver to a rapid increase of the envelope level is not affected by relatively slowly occurring changes of the envelope level because the level denoted by the line L of FIG. 2(*b*) changes likewise. Of course, the presence of a logic "1" at the output terminal 10 denotes the presence of a sensed vehicle so that the pulse waveform produced at the output terminal 10 can be fed to a counter for counting the number of vehicles sensed. As the duration of each pulse produced at the output terminal 10 is related to the duration of the disturbance produced by the sensed vehicle and hence to the length of the vehicle, the information produced at the output terminal 10 may be employed in combination with information related to the speed of the sensed vehicle to determine the length of each sensed vehicle. Alternatively, the information produced at the output terminal 10 may be employed to detect when a vehicle is stationary over the sensing means.

In the system of FIG. 1, a sampler and a storage means formed by the sample and hold stage 6 in association with the sampling pulse source 8, together with the comparator 7 form an identification means in accordance with the invention and also function as a pulse formation means of the kind referred to earlier. However, in the system of FIG. 4, a sampler, a storage means and a comparator form an identification means in accordance with the invention and function in combination with a separate pulse formation means of the kind referred to.

Referring now to FIG. 4, similar parts of the system of FIG. 1 are denoted by similar numerals or letters. The sampling pulses from the source 8 are applied directly to the sampling pulse input SP6 of the sample and hold stage 6 so that the supply of sampling pulses is not suppressed as in the case of the system of FIG. 1 and the stepwise waveform W6 of FIG. 1(*e*) depict the wave shape of the output signal produced at the output terminal OP6 in response to the reception of a signal corresponding to that of FIG. 2(*a*). Accordingly, in response to reception of a signal corresponding to that of the waveform W1 of FIG. 2(*a*), a voltage having a wave shape coinciding with that of the waveform W2 of FIG. 2(*b*) is produced at the input terminal IP7/2 of the comparator 7 and a voltage having a wave shape coinciding with that of the waveform W6 of FIG. 2(*a*) is produced at the input terminal IP7/1 of the comparator 7.

As the information output terminal 10 is activated only when the voltage at the input terminal IP7/2 exceeds that of the input terminal IP7/1 by a fixed quantity, the output terminal 10 is not, in this case, continuously activated between the instants T6 and T7. Instead, the output 10 is activated following the occurrence of the individual sampling pulses during sharply rising portions of a positive going disturbance as depicted by the waveform W7 of FIG. 2(*f*) which shows the voltage consequently produced at the output terminal OP7 and hence at the information output terminal 10. The portion of the waveform W7 during which the outut terminals OP7 and 10 are activated are denoted by the pulses P1 to P4. It will be understood that such pulses are each produced occurrence of a a sampling pulse and as a consequence of the level of the wave W2 exceeding the level of the stored voltages, as denoted by the waveform W6, by the aforementioned fixed quantity, before the occurrence of the next succeeding sampling pulse. In other words, there is activation of the information output terminal 10 only when the envelope level rises sufficiently sharply between consecutive sampling pulses that the fixed quantity is exceeded.

In the system of FIG. 4, a second storage means is provided in the form of a data memory stage 11 which is connected to a second comparator 12 to form there-with a separate pulse forming means for forming vehicle indication pulses of duration related to the duration of positive going disturbances producing activation of the identification circuit formed by the sample and hold stage 6 and the comparator 7. The data memory stage 11 is of a known kind and is schematically illustrated in greater detail in FIG. 5. The second comparator 12 is also of a known kind being similar to the comparator.

As illustrated in FIG. 5, the data memory stage 11 comprises an analog to digital converter portion A/D11, a digital store DG11 and a digital to analog converter portion D/A11. The analog to digital converter portion A/D11 converts analog data applied to the input terminal D11 into binary encoded information which is applied to the multiple inputs of the digital store DG11. The digital store DG11 operates in either a "storage mode" or a "non-storage mode" and in the "storage mode" is capable of storing binary encoded information for indefinite periods. The "storage mode" function of the digital store DG11 is controlled by signals applied to the storage command input terminal C11 in a known manner such that a transition from a logic "0" to a logic "1" at the input terminal 11 causes binary encoded information present at the multiple inputs of the digital store DG11 at the instant of the transition to be transferred to and stored at the multiple outputs of the digital store DG11 until reset to the "non-storage" mode.

Application of a logic "1" to the reset terminal R11 resets the digital store DG11 to a "non-storage" mode in which information present at the multiple inputs is effectively transferred continuously to the multiple outputs. The digital to analog converter portion D/A11 converts binary encoded information present at the multiple outputs of the digital store DG11 into a corresponding analog signal at the output terminal 011.

Returning to FIG. 4, the output of the demodulator 5 is supplied to the data input D11 of the data memory stage 11 and also to the input IP12/2 of the comparator 12. The information output terminal 10 is connected to the storage command input terminal C11 of the data memory stage 11 whose output terminal 011 is connected to the other input IP12/1 of the comparator 12. The output of comparator 12 is applied to the reset terminal R11 of the stage 11, as well as to the output terminal 13. The output of the comparator 12 is applied to the reset terminal R11 via a monostable multivibrator (not shown) which produces a short positive-going pulse in response to a transition at the output of the comparator 12 from a logic "1" to a logic "0".

In operation, as in the case of the system of FIG. 1, identification of a positive-going disturbance of the envelope of the received signal activates the information output terminal 10. In the system of FIG. 4, however, activation of the terminal 10 also simultnaeously activates the storage command input terminal C11 of the data memory stage 11. The transition at the terminal C11, when the terminal 10 is activated, causes the data memory stage 11 to operate in the storage mode producing an output voltage at the terminal 011 and also at the input terminal IP12/1 corresponding to the envelope level of the received signal at the instant of such activation. Since a signal corresponding to the envelope level of the received signal is applied continuously to the other input terminal. IP12/2, a sufficient further increase in the level of the envelope of the received signal before the next sampling instant causes a logic "1" to be produced at the output of the comparator 12 and at the output terminal 13. The logic "1" continues to be produced at the output terminal 13 until the level of the received signal envelope has fallen below the envelope level at the instant of activation of the command terminal C11. The related sequence of events can be understood by reference to FIGS. 2(*b*), 2(*e*), 2(*f*) and 2(*g*).

Assuming a signal such as that depicted by FIG. 2(*a*) is received, then the waveform W6 is produced at the input terminal IP7/1 and the information output terminal 10 is activated as indicated by the pulses P1, P2, P3 and P4 of FIG. 2(*f*). The leading edge of the pulse P1 at the instant T6 causes the data memory 11 to go to the "storage mode" and store a voltage at its output terminal 011 corresponding to the envelope level of the received signal at that instant i.e. the level of the waveform W2 at the instant T6. As the waveform W2 continues to rise after the instant T6, the voltage at the input terminal IP12/2 of the comparator 12 exceeds the voltage at the terminal IP12/1 shortly after the instant T6 causing a logic "1" to be produced at the output terminal 13. The data memory 11 remains in the storage mode until the instant T7 when the level of the waveform W2 falls below its level at the instant T6 so that a pulse P5 is produced at the output terminal 13 having a length related to that of the disturbance D of the waveform 1. Transition from a logic "1" to logic "0" at the terminal 13 is communicated to the reset terminal R11 causing the data memory stage 11 to be reset to the non-storage mode so that there is no difference in the voltages produced at the input terminals IP12/1 and IP12/2 until the terminal C11 is next activated. Thus, until the next activation a logic "0" is produced at the terminal 13.

Thus, the presence of a logic "1" at the output terminal 13 denotes the presence of a sensed vehicle so that the pulse waveform produced at the output terminal 13 can be fed to a counter for counting the number of vehicles sensed. Again, since the duration of each pulse produced at the output terminal 13 is related to the duration of the disturbance produced by a sensed vehicle and hence to the length of the vehicle, the information produced at the output terminal 13 may be employed in combination with information related to the speed of the sensed vehicle to determine the length of each sensed vehicle. Alternatively, the information produced at the output terminal 13 may be employed to detect when a vehicle is stationary within the sensing zone.

A practical variation of the system of FIG. 4 is illustrated in FIG. 6. The system of FIG. 6 is fundamentally similar to that of FIG. 4 and again like parts are denoted by like numerals or letters. However, means are provided for indicating when a sensed vehicle is at a standstill within the zone of influence and, in addition, other means are provided for producing a sharply defined pulse of short duration in response to each positive going disturbance of the envelope of the received signal identified as being produced by an approaching vehicle.

Referring now to FIG. 6, the RF output signal of the receiving stage 4 is also fed to a dividing stage 14 which is sensitive to the RF signal and not to variations in its envelope level. The dividing stage 14 functions as a source of sampling pulses or clock pulses which are respectively applied to the sample and hold stage 6 and to the input of a shift register 16. Accordingly, in FIG. 6 the source 8 (of FIG. 4) is not provided. The division ratio of the dividing stage 14 should be chosen in accordance with the information ultimately intended to be derived from the received signals. By way of example, it will be assumed that the dividing stage 14 has a division ratio of 1:20 (assuming the frequency of the RF output signal of the receiving stage 4 is 100 Kilohertz) to produce sampling pulses having a pulse duration of aporoximately 10 microseconds each and having a pulse repetition frequency of 5 Kilohertz.

Again, the demodulated output signal of the demodulator stage 5, which corresponds with the envelope level of the received signal, is fed simultaneously to the sample and hold stage 6, to the data input of the data memory stage 11 and to one of the inputs of the unidirectional comparison stage 12. However, in this case, a bi-directional comparator 15 is employed in lieu of the uni-directional comparator 7 (of the FIG. 4 system). Accordingly, the output of the demodulator stage 5 is also applied to one input of the comparator 15 and the output of the sample and hold stage 6 is fed to the other input of the comparator 15.

The bi-directional comparator 15 is of a known kind and its operation is such that a logic "0" is produced at its output terminal OP15 when the voltage at the input terminal IP15/2 is substantially equal to (within fixed quantity limits) that at the input terminal IP15/1 but a logic "1" is produced at the output terminal OP15 whenever the voltage at the terminal IP15/2 falls outside fixed quantity limits above and below the voltage at the terminal IP15/1. The output of the bi-directional comparator 15 is connected to the terminal 10 which corresponds with the information terminal 10 of FIGS. 1 and 4.

The information terminal 10 is connected to one input of the "and" gate 16 to the other input of which the output of the comparator 12 is fed via the inverter 17. The output of the gate 16 is connected to the output terminal 18 and also to the storage command input terminal C11 of the data memory stage 11. The information terminal 10 is also connected to the reset terminal R16 of the shift register 16, the output of which is connected to one input of the "and" gate 19. The output of the comparator 12 is fed to the remaining input of the "and" gate 19, the output of the "and" gate 19 being connected to the output terminal 20.

The shift register 16 is of a known kind having four bi-stable stages in cascade. Upon reset, the shift register 16 is set to an initial state in which all stages are unloaded (i.e. in a logic "0" stage) so that a logic "0" is consequently produced at the shift register output. Each pulse applied to the shift register input simultaneously advances the shift register state and loads a logic "1" into the first stage. Accordingly, a succession of four or more pulses, without reset, produces a logic "1" at the shift register output, otherwise a logic "0" continues to be produced. As the output of the shift register 16 is fed via the "and" gate 19 to the output terminal 20, a succession of four or more sampling pulses without reset of the shift register 16 produces a logic "1" also at the output terminal 20 provided the gate 19 is opened by the presence of a logic "1" simultaneously at the output of the comparator 12, the presence of a logic "1" at the terminal 20 indicating a sensed vehicle is at a standstill within the sensing zone.

The arrangement comprising the "and" gate 16 and the inverter 17 is provided so that a single pulse of short duration is produced at the output terminal 18 by the entry of a vehicle into the sensing zone. The pulses produced at the terminal 18 is well suited for application to a counter for counting the number of vehicle sensed.

The output of the comparator 12 is applied to the reset terminal R11 via a monostable multi-vibrator 21 which forms a short duration pulse in response to a transition from logic "1" to logic "0" at the output of the comparator 12.

Figure 7:
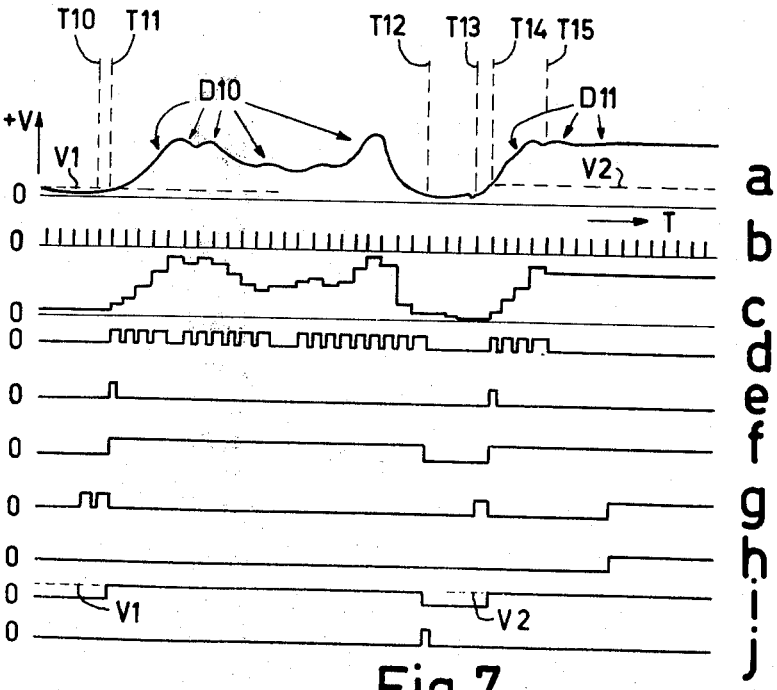

The operation of the system of FIG. 6 may be better understood from the waveforms illustrated in FIG. 7 which show, by way of example, the waveforms of signals produced at various parts of the system as a consequence of the passage of a first vehicle through the sensing zone followed by the entry of a second vehicle into the sensing zone wherein the second vehicle comes to a standstill.

FIG. 7(*a*) shows the waveform produced at the output of the demodulator 5 corresponding with the envelope of the received signal. Between the instants T10 and T12, a first sensed vehicle is passing through the sensing zone resulting in the positive-going disturbance 10. Between the instants T12 and T13 there is no vehicle within the sensing zone. Between the instants T13 and T15 a second sensed vehicle is entering the sensing zone resulting in the positive-going disturbance D11, the second vehicle being stationary within the sensing zone from the instant T15 onwards.

FIG. 7(*b*) shows the waveform produced at the output of the divider 14 showing the train of sampling pulses supplied simultaneously to the sample and hold stage 6 and to the shift register 16.

FIG. 7(*c*) shows the stepwise waveforms of the signal produced at the output of the sample and hold stage 6 and supplied to the input terminal IP15/1 of the bi-directional comparator 15.

FIG. 7(*d*) shows the waveform produced at the output terminal OP15 of the bi-directional comparator 15 and hence also at the information terminal 10 as a result of the comparison of the respective waveforms of FIG. 7(*a*) and FIG. 7(*c*). It will be noted the terminal 10 is activated by the presence of a logic "1" each time the voltage of the waveform of FIG. 7(*a*) changes in excess of a fixed quantity relative to the respect stored sample voltages of the stepwise waveform of FIG. 7(*c*) during the intervals between consecutive sample pulses.

FIG. 7(*e*) shows the waveform produced at the output of the "and" gate 16 and applied to the terminal C10 of the data memory stage 11 and also to the output terminal 18. It will be realised that during the disturbance D10, the first activation of the terminal 10 occurs at the instant T11 at which time a logic "0" is present at the output of the comparator 12 so that the gate 16 is open. However, as the leading edge of the disturbance D10 continues to rise, a logic "1" is produced at the output of the comparator 12 shortly after the instant T11 causing closure of the gate 16 so that the pulses of the waveform of FIG. 7(*e*) are of short duration, no further pulses being produced at the output terminal 18 for the duration of the disturbance D10.

FIG. 7(*i*) shows the waveform produced at the output of the data memory stage 11 during the respective "non-storage" and "storage" modes. When in the storage mode during the disturbance D10, the voltage produced at the output of the memory stage 11 is indicated as V1, coinciding with the voltage V1 of the waveform of FIG. 7(*a*) at the instant T11 i.e. the instant at which the information terminal 10 is activated. Similarly, when in the storage mode during the disturbance D11, the voltage produced at the output of the memory stage 11 is indicated as V2, coinciding with the voltage V2 of the waveform of FIG. 7(*a*) at the instant T14. Of course, the relative magnitudes of V1 and V2 may differ significantly.

FIG. 7(*f*) shows the waveform produced at the output of the unidirectional comparator 12 and at the output terminal 13 as a consequence of the waveforms of FIG. 7() and FIG. 7(*a*) being compared. It will be noted that during the disturbance D10 a logic "1" is produced at the output of the comparator 12 from an instant shortly after the instant T11 when the voltage of the waveform of FIG. 7(*a*) exceeds the voltage V1 at the output of the memory stage 11 until the instant T12 when the voltage of the waveform of FIG. 7(*a*) falls below the voltage V1 at the output of the memory 11. Similarly, during the disturbance D11, a logic "1" is produced at the output of the comparator 12 from an instant shortly after the instant T14 when the voltage of the waveform of FIG. 7(*a*) exceeds the voltage V2 stored at the output of the memory 11. A logic "0" is produced at the output of the comparator 11 between the instants T12 and T14.

FIG. 7(*g*) shows the waveform of the voltage produced at the output of the shift register 16. Immediately prior to the instant T10 a logic "1" is present at the shift register output because there has been a series of sampling pulses, in excess of four, applied to the shift register input without re-set of the shift register 16. Between the instants T10 and T12, a logic "0" is produced at the output of the shift register 16 owing to repeated resetting of the shift register as a consequence of repeated activation of the terminal 10 indicated by the waveform of FIG. 7(*d*). Between the instants T12 and T13 there is no reset of the shift register 16 and the shift register is advanced three times and accordingly at the instant T13 a logic "1" is produced and remains until the occurrence of the next succeeding sampling pulse whereupon re-set of the shift register 16 occurs. Whereupon a logic "0" is produced at the shift register output. Again, following the instant T15 when the sensed vehicle causing the disturbance D11 has come to a standstill, the shift register 16 is advanced sufficiently for a logic "1" to be produced at its output.

FIG. 7(*h*) shows the waveform of the voltage produced at the output terminal 20 as a consequence of the waveform of FIG. 7(*g*) being applied to one input of the "and" gate 19 and an inverted version of the waveform of FIG. 7(*f*) being applied to the other input. A logic "1" is produced at the output terminal 20 only in response to a stationary vehicle within the sensing zone i.e. subsequent to the instant T15 during the disturbance D11.

FIG. 7(*j*) shows the waveform produced at the output of the monostable multivibrator 21 showing a single pulse produced by the multivibrator in response to the transition of the waveform of FIG. 7(*f*) from a logic "1" to a logic "0", the single pulse indicated resetting the data memory stage 11 to the non-storage mode.

Many variations of the embodiments of the invention described in relation to the systems of FIGS. 1, 4 and 5 will be apparent to persons skilled in the art. For instance, for the sake of simplicity in relation to the system of FIG. 6 a four stage shift register is provided whereas it will be evident that a shift register having a greater number of stages will be more appropriate in many cases, the choice of the number of stages depending upon the pulse repetition frequency of the respective sampling pulse source and the performance characteristics required of the system itself. Such variations are intended to be included within the scope of the present invention.

What is claimed is:

1. A vehicle detection system comprising a transmitter for supplying a continuous wave signal, a receiver and sensing means for coupling said continuous wave signal to said receiver so that the passage of a vehicle produces a disturbance in the envelope of the signal received by said receiver, said receiver including means for deriving, from the received signal, sample voltages corresponding to the level of the envelope of the received signal at periodically reoccurring sampling instants, storage means for storing each sample voltage until the next succeeding sampling instant, means for comparing each storage sample voltage with the envelope level of the received signal and generating a first signal indicative of the presence of a vehicle when the difference between the envelope level and the stored sample voltage exceeds a predetermined quantity and for terminating said first signal when said difference drops below said predetermined quantity thereby identifying disturbances of the envelope of the received signal having a rapidly changing leading edge produced by an approaching vehicle, and feedback means for preventing the storage means from storing further samples in response to said first signal.

2. The system according to claim 1 wherein said comparing means produces said first signal when the envelope level exceeds the stored sample voltage by a predetermined quantity to thereby identify positive-going disturbances of the envelope having a sharply rising leading edge produced by the approach of a vehicle.

3. The system according to claims 1 or 2 wherein said receiver includes an information output and wherein said comparing means comprises means, responsive to said first signal, for producing at said information output a pulse of duration related to that of the disturbance in the envelope of said received signal.

4. The system according to claim 3 wherein said pulse producing means includes a second storage means having reset means and a data input, data output and storage command terminals wherein, following reset, data present at the data input terminal are transferred to the data output terminal and, following activation of the storage command terminal, data present at the data input terminal at activation are transferred to and stored at the data output terminal until further reset, means for applying a signal representative of the envelope level of the received signal to said data input terminal, means for coupling said first signal to said storage command terminal, a comparator having a pair of inputs and an output, means for applying a signal representative of the envelope level to one of said inputs of said comparator, means for coupling said data output terminal to the other of said inputs of said comparator, and means for coupling the output of said comparator to said reset means and to said information output, said comparator producing at said comparator output a signal forming said pulse when said signal representative of said envelope level is greater than the level of the signal at said data output terminal.

* * * * *